US011838723B2

(12) United States Patent
Nowak

(10) Patent No.: US 11,838,723 B2
(45) Date of Patent: Dec. 5, 2023

(54) MICROPHONE CAPSULE, MICROPHONE ARRANGEMENT WITH A PLURALITY OF MICROPHONE CAPSULES AND METHOD FOR CALIBRATING A MICROPHONE ARRAY

(71) Applicant: Sennheiser electronic GmbH & Co. KG, Wedemark (DE)

(72) Inventor: Alexander Nowak, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 17/294,083

(22) PCT Filed: Dec. 12, 2019

(86) PCT No.: PCT/EP2019/084943
§ 371 (c)(1),
(2) Date: May 14, 2021

(87) PCT Pub. No.: WO2020/126843
PCT Pub. Date: Jun. 25, 2020

(65) Prior Publication Data

US 2022/0030360 A1 Jan. 27, 2022

(30) Foreign Application Priority Data

Dec. 17, 2018 (DE) ..... 10 2018 132 486.3

(51) Int. Cl.
*H04R 19/04* (2006.01)
*H04R 1/22* (2006.01)
(Continued)

(52) U.S. Cl.
CPC ..... *H04R 19/04* (2013.01); *H04R 1/222* (2013.01); *H04R 3/06* (2013.01); *H04R 29/006* (2013.01)

(58) Field of Classification Search
CPC ..... H04R 19/04; H04R 1/222; H04R 1/326; H04R 1/406; H04R 3/06; H04R 29/006
See application file for complete search history.

(56) References Cited

U.S. PATENT DOCUMENTS

2003/0223611 A1 12/2003 Hohjyo
2008/0075306 A1* 3/2008 Poulsen ..... H04R 19/005 381/59

(Continued)

FOREIGN PATENT DOCUMENTS

DE 10 2012 203 741 9/2012
JP 2004-007156 A 1/2004

(Continued)

OTHER PUBLICATIONS

Anonymous. "Model: CMC-4013-SMT-TR—Description: ELECTRET Condenser Microphone Additional Resources: Product Page : 3DModel : PCB Footprint" Nov. 28, 2016 (Nov. 28, 2016), Retrieved Mar. 6, 2020 from Internet Internet:URL:https://www.cuidevices.com/product/resource/cmc-4013-smt-tr.pdf XP055674518, pp. 1, 2, 5.

(Continued)

*Primary Examiner* — Jason R Kurr
(74) *Attorney, Agent, or Firm* — Eugene LeDonne; Haug Partners

(57) ABSTRACT

Microphone capsules for condenser or electret microphones often exhibit individual deviations from a desired ideal behavior, e.g. the frequency response and phase response. Particularly if a plurality of microphone capsules are interconnected to form a microphone array, suitable microphone capsules must be found in a selection process. Some of these deviations can be corrected electronically, e.g. by filtering with a corresponding filter that is individually adapted. An improved microphone capsule, with which an automatic selection and automatic assembly of circuit boards with (Continued)

microphone capsules is facilitated, comprises an electrostatic sound transducer, an amplifier element that outputs an amplified output signal of the electrostatic sound transducer, and at least one electronic memory element. Data obtained by a measurement and relating to the individual frequency response or phase response of the respective microphone capsule can be stored therein. The data can be read out during manufacturing and during operation, which enables automatic sorting of the capsules during production and automatic calibration of the target circuit in operation.

12 Claims, 3 Drawing Sheets

(51) Int. Cl.
*H04R 3/06* (2006.01)
*H04R 29/00* (2006.01)

(56) References Cited

U.S. PATENT DOCUMENTS

2008/0219483 A1 9/2008 Klein et al.
2012/0230522 A1* 9/2012 Nowak ..... H04R 19/02 381/174
2014/0266260 A1 9/2014 Wurzinger et al.
2014/0321664 A1* 10/2014 Huang ..... H04R 29/005 381/92
2016/0344358 A1* 11/2016 Oliaei ..... H03G 5/165
2019/0132693 A1* 5/2019 Walser ..... H04R 19/005
2020/0154223 A1* 5/2020 Du ..... H04R 19/04

FOREIGN PATENT DOCUMENTS

KR 20080045037 5/2008
WO WO 2017/105548 6/2017
WO WO 2017/143177 8/2017

OTHER PUBLICATIONS

International Search Report for PCT/EP2019/084943 dated Mar. 19, 2020.
German Search Report for Application No. DE 10 2018 132 486.3 dated Sep. 23, 2019.
Maxim Integrated Products, Inc.: Data Sheet for DS28E04 1-wire EEPROM, San Jose CA, USA, 19-6568; Rev 2; Jan. 17, 2017, https://datasheets.maximintegrated.com/en/ds/DS28E05.pdf [retrieved on Sep. 23, 2019.
Office Action dated Mar. 28, 2023 issued in the corresponding Japanese patent application No. 2021-534796.

* cited by examiner

MICROPHONE CAPSULE, MICROPHONE ARRANGEMENT WITH A PLURALITY OF MICROPHONE CAPSULES AND METHOD FOR CALIBRATING A MICROPHONE ARRAY

CROSS-REFERENCE TO RELATED APPLICATIONS

This application is the National Stage entry under 35 U.S.C. § 371 of International Application No. PCT/EP2019/084943 filed Dec. 12, 2019, published as Publication No. WO 2020/126843 on Jun. 25, 2020, which claims benefit of foreign priority of German Patent Application No. 10 2018 132 486.3, filed on Dec. 17, 2018, the entireties of which are herein incorporated by reference.

FIELD OF DISCLOSURE

The invention relates to a microphone capsule, a microphone arrangement with a plurality of microphone capsules, and a method for calibrating a microphone arrangement.

BACKGROUND

Microphone capsules are components that are used in microphones and that are normally soldered onto circuit boards. Microphone capsules for condenser or electret microphones are often manufactured using the so-called stacking technique, wherein several parts are stacked one after the other in a housing. However, there are component tolerances, resulting in each microphone capsule having individual deviations from a desired ideal electro-acoustic behavior, like e. g. the frequency response and/or phase response. For high quality requirements, and in particular if a plurality of microphone capsules are interconnected in a microphone array, these deviations need to be compensated electronically, e. g. by filtering with a corresponding filter that is individually adapted. For this purpose, the characteristic values such as the frequency response and/or phase response must first be measured. If this measurement is done after soldering the microphone capsule onto a circuit board, the connected circuit may falsify the result. If the measurement is done before the soldering, there occurs the problem that the capsules need to be sorted, depending on the measurement result. This selection, which is error-prone and laborious and often done manually, makes it particularly difficult and expensive to equip circuit boards with microphone capsules by machine. Therefore, only a small proportion of the capsules can be used, namely those with very low deviations, so as to keep the effort low.

The following documents have been considered relevant by the German Patent and Trademark Office (DPMA) for the priority application. DE 10 2012 203 741 A1, US 2008/0 219 483 A1 and Maxim Integrated Products, Inc.: Data Sheet for DS28E04 1-wire EEPROM, San Jose CA, USA, 19-6568; Rev 2; 1/17, 2017, https://datasheets.maximintegrated.com/en/ds/DS28E05.pdf [retrieved on 23 Sep. 2019].

US2008/0219483 A1 discloses an acoustic module that can be used as a microphone array and that comprises two or more microphone capsules, an electronic circuit for signal processing and a memory. After mounting the microphone capsules into the module, they may be tested. The calibration information for the capsules which is obtained in the testing process as well as positional deviations of the capsules within the acoustic module are stored in the memory and are provided to the internal signal processing for configuring filters.

SUMMARY OF THE INVENTION

It is an object of the present invention to provide an improved microphone capsule with which an automatic assembly of circuit boards with microphone capsules is facilitated. It is a further object to provide a simplified manufacturing method for microphone arrays and to provide the corresponding microphone arrays.

A microphone capsule according to the invention is disclosed in claim 1. It comprises an electrostatic sound transducer, an amplifier element or impedance converter that outputs an amplified or impedance converted output signal of the electrostatic sound transducer, respectively, and at least one electronic memory element. In the memory element, data may be stored that were obtained by a measurement and that relate to the individual frequency response or phase response of the respective microphone capsule. The data can be read out during the manufacturing process and during operation, which enables both an automatic sorting of the capsules during production as well as an automatic calibration of the target circuitry during operation.

Claim 10 relates to a microphone arrangement, such as e. g. an array, with at least two microphone capsules. Claim 12 relates to a method for calibrating a microphone array.

Further advantageous embodiments are disclosed in the dependent claims.

BRIEF DESCRIPTION OF THE DRAWINGS

Further details and advantageous embodiments are depicted in the drawings, showing in FIG. 1 shows a circuit diagram of a microphone capsule, in one embodiment.

DETAILED DESCRIPTION

Figure 1:
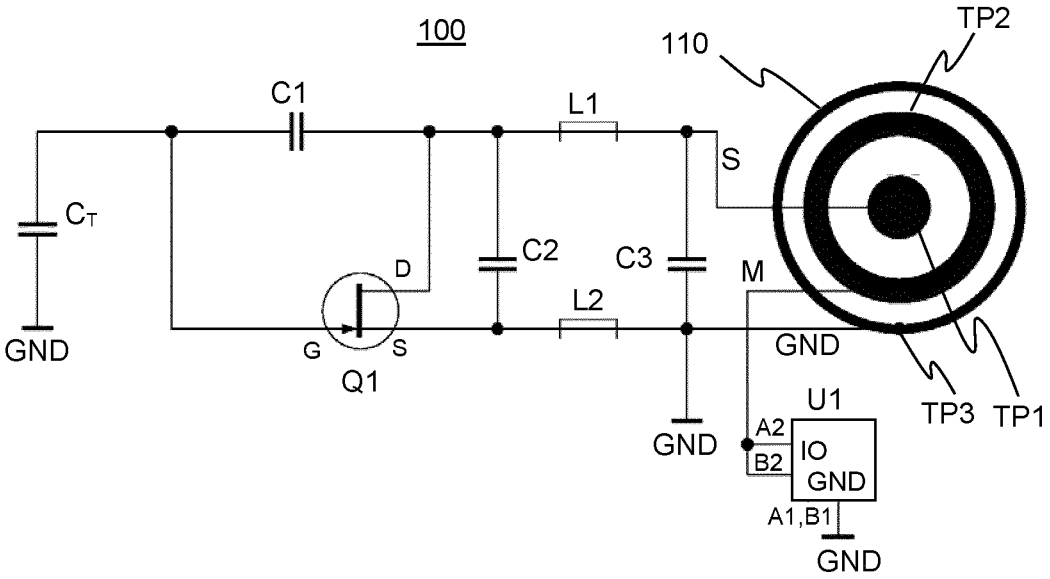

FIG. 1 shows in an embodiment a circuit diagram 100 of a microphone capsule according to the invention. Within the housing of the microphone capsule there are an electrostatic sound transducer $C_T$ that is depicted here by its equivalent circuit as a capacitor, an amplifier element Q1 such as e. g. a FET (Field Effect Transistor) and a memory element U1. The electrostatic sound transducer $C_T$ may be e. g. an electret or condenser microphone. The amplifier element Q1 serves in electret microphones also as impedance converter and may then have a very low gain factor of e. g. 1. Further, various analog components C1-C3,L1,L2 for frequency response correction, interference protection, adaptation or pre-filtering are contained. These are optional, but common in electrostatic microphone capsules. E. g. C2,C3,L1,L2 are used to filter out high-frequency interference signals. The microphone capsule is connected via electrical contacts 110 which in this example are located on the bottom of the housing. These contacts include a connector TP1 for the output signal or the power supply, respectively, a connector TP2 for the memory element U1 and a connector TP3 for a reference potential, usually ground GND. The memory element U1 has four connections in this example, wherein two of the connections A2,B2 are connected to the connector TP2 and the remaining connections A1,B1 are connected to ground GND. The memory element U1 may be a digital, electronically erasable single wire memory element (1-wire-EEPROM) which can be written and read in a serial manner via the connector TP2. Thus, the connector TP2 serves as power supply, clock line and data line for the memory element. It is an advantage of this separate connector TP2 that writing and reading may be done independently of the remaining circuitry that is within the microphone capsule. Except for the memory element U1 and its connector TP2, the above-described circuit may be a conventional circuit of a microphone capsule and may in other embodiments be replaced by another conventional circuit.

Figure 2:
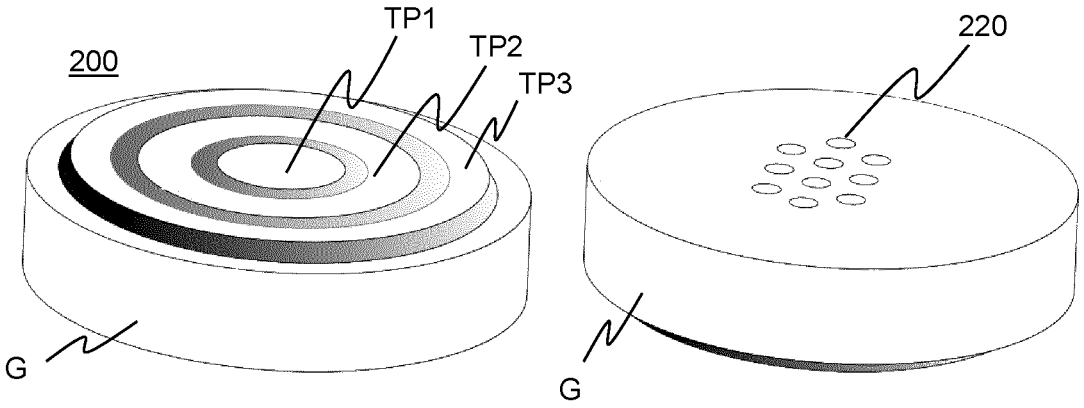
FIG. 2 shows exemplary bottom and top views of a microphone capsule.

FIG. 2 shows exemplary bottom and top views of a microphone capsule 200 in an embodiment. A metallic housing G has openings 220 on the top through which the sound can reach the diaphragm below. On the bottom there are the connectors TP1-TP3 which in this example are essentially circular and concentric. As a result, the microphone capsule has an external shape that is rotationally symmetric, which facilitates automated assembly. The connectors are metallic and at least two of the connectors are insulated from the housing G. Moreover, the connectors TP1-TP3 are in this example slightly raised compared to the housing, e. g. by about 0.5 mm, so that it is easier to automatically solder the microphone capsule onto a circuit board.

Figure 3:
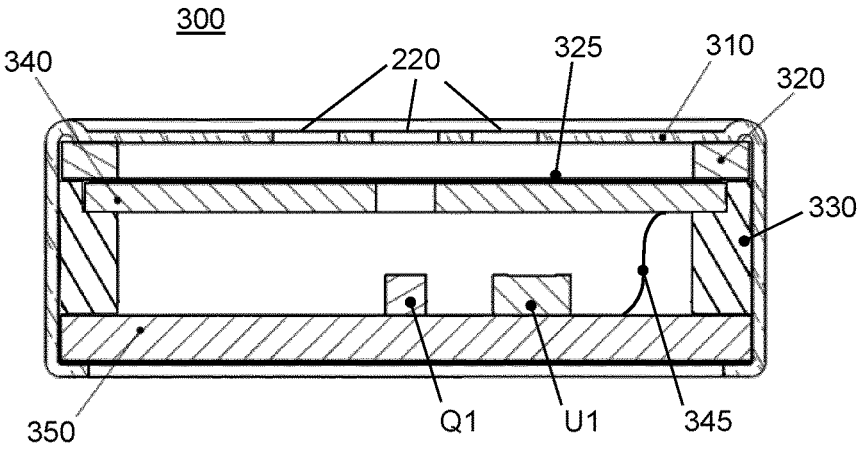
FIG. 3 shows a sectional drawing of an exemplary microphone capsule.

FIG. 3 shows a cross section through a microphone capsule 300 depicted in a simplified manner, according to an embodiment of the invention. On the top of the housing 310 there are openings 220 for allowing the sound to pass through to the diaphragm 325 underneath. The diaphragm 325 is coated with metal and fixed on a diaphragm ring 320. Both together form a diaphragm assembly. The diaphragm ring 320 also ensures that a distance is maintained between the diaphragm and the upper side 310 of the housing. A slim air gap (not shown) between the diaphragm 325 and the counter electrode 340 underneath provides electrical insulation between both parts and enables the diaphragm to vibrate. The counter electrode 340 is connected in an electrically conductive manner to the lower circuit board 350, e.g. by a contact spring 345. The metallic coating of the diaphragm and the counter electrode 340 together form a capacitor $C_T$ with a variable capacity that serves as a sound transducer. The circuit board comprises further electronic components, e. g. as shown in FIG. 1, among them the amplifier element Q1 and the memory element U1. The capsule may be manufactured using e. g. the so-called stacking technique, wherein the single parts one after the other are stacked into the housing, beginning with the diaphragm assembly. A distance between the counter electrode 340 and the circuit board 350 is maintained by using an insulation ring 330. However, each microphone capsule has individual deviations from a desired ideal frequency response and/or phase response due to electrical or mechanical component tolerances, respectively. For high quality requirements, in particular if a plurality of microphone capsules are interconnected in a microphone array, these deviations can be compensated at least partially electronically.

Figure 4:
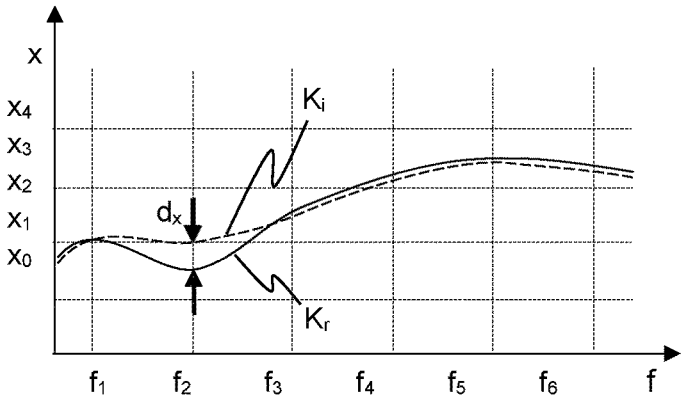
FIG. 4 shows frequency-dependent measurement values of a microphone capsule.

For this, the characteristic values of the capsule such as e.g. the frequency response are measured. In a variant it is also possible to determine deviations against an ideal curve. FIG. 4 shows exemplarily frequency-dependent measurement values of a microphone capsule, wherein the curve $K_r$ of the actual measurement values deviates from the ideal curve $K_i$ at a frequency $f_2$ by an amount of $d_x$. For the other frequencies $f_1$,$f_3$-$f_6$ at which measurements were made, the deviations are very small, i. e. below a threshold or a measurement tolerance, respectively, and may be ignored. In one embodiment, the determined measurement values such as for example the absolute values and/or phases at different frequencies are stored in the memory element U1. In another embodiment, the deviations $d_x$ of the measurement values against the ideal curve $K_i$ are stored in the memory element U1. This variant has the advantage that the deviations and thus the numeric values to be stored are smaller and require less storage. The measuring and storing is preferably done before soldering the capsule, but in principle may also be done afterwards. The memory element U1 may be an electronically erasable single wire memory element, such as e. g. a 1-wire-EEPROM of the type DS28E05 with a storage volume of 112 bytes or 1 kBit, respectively, which requires only an area of 1-3 $mm^2$ on the circuit board. It is also possible to use a plurality of these memory elements or other memory elements with a higher storage volume, so that more data can be stored and a more precise correction is possible. In an embodiment, further non-individual data, such as a model code, manufacturing date, batch number etc., can additionally be stored in the memory element.

An advantage of the microphone capsule according to the invention is that each specimen has its individual characteristic values with it permanently, so that in a simple manner a sorting of the capsules during manufacturing as well as a calibration of the target circuitry during operation is much easier possible. In particular, no measurement is required any more for calibrating the target circuitry. Since manual adjustment and manual sorting always mean an increased production effort, the invention simplifies the production and/or calibration of devices or modules that contain microphone capsules. The measuring of the single microphone capsules is done anyway and is therefore no additional effort. After the capsule is soldered on the board and the circuit is taken in operation, a processor may retrieve during an initialization phase the values stored in the memory element U1 and use them for configuring, individually for each microphone capsule, a corresponding correction circuit. For a microphone capsule having a measurement curve $K_r$ as shown in FIG. 4, for example, a correction filter may be configured that raises the frequency response at the frequency $f_2$ by an amount of $d_x$, so that essentially the ideal curve $K_i$ results. Compared to known solutions, the calibration may therefore be done fully automatically and thus much easier and faster.

Figure 5:
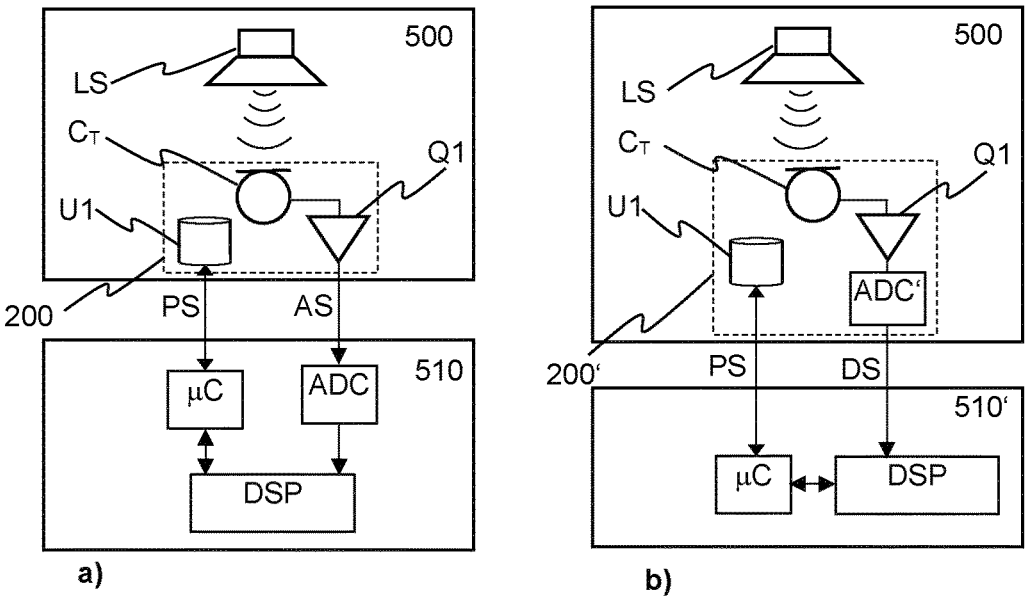
FIG. 5 shows a measurement setup.

In FIG. 5 there is schematically depicted a measurement setup for obtaining the characteristic values and storing them in the microphone capsule. FIG. 5 *a*) exemplarily shows a measurement setup with a so-called coupling measurement for an analog microphone capsule 200. In a closed volume 500 there is a loudspeaker LS and the microphone capsule 200 to be measured, comprising the sound transducer $C_T$, the amplifier element Q1 and the memory element U1. Further electronic components like in FIG. 1 for example may also be there, but are not shown in FIG. 5. The loudspeaker LS emits a sound sequence with different frequencies that each generate a precisely defined sound pressure level at the microphone capsule 200. This is converted by the microphone capsule 200 into an electrical signal for output. A programming device 510 such as for example a computer that is correspondingly configured gets the analog output signal AS of the microphone capsule and converts it into digital signals in an analog-to-digital-converter ADC. A processor DSP compares the digital signals with a stored ideal curve and determines difference values. Alternatively, the difference values can in principle be obtained also from the analog signals and then digitized. In one embodiment, these difference values are written as a programming signal PS into the memory element U1, in other embodiments it is the measurement values themselves or other values generated from them which represent the individual properties of the capsule. The stored values may also be retrieved again, for example in order to ensure that the writing process was successful and the memory element works properly. The formatting of the value and the writing process, as well as possibly the reading process of the written values for verification, may be performed directly by the processor DSP or by a separate microcontroller □C connected to this processor. If the memory element U1 is a single wire memory element, a serial protocol provided for this purpose can be used for writing or reading, respectively.

FIG. 5 *b*) shows exemplarily a similar measurement setup for a digital microphone capsule 200'. An analog-to-digital converter ADC' is disposed within the microphone capsule 200', whose output signal DS is a digital signal. In this case, a digital input of the programming device 510' may be used, instead of an analog input as in FIG. 5 *a*).

The microphone capsules according to the invention may be used advantageously in particular for microphone arrays, for this requires each microphone capsule to reach ideal values at very small tolerances with respect to magnitude (i.e. absolute value) and phase. For example, a sensitivity tolerance of +/−1 dB may be required over a wide frequency range, for example from 400 Hz to 8 kHz. Instead of manually selecting the microphone capsules during the manufacturing process, the capsules can now be sorted automatically by reading out the measured values from each capsule by a processor before the microphone capsules are soldered, and it is possible to use, for example, only those capsules whose measured values are within certain specified limits. Alternatively or additionally, a processor contained in the device can read out the values of each individual capsule after soldering and commissioning, and can use them to configure an adaptive correction filter individually for the respective capsule. The calibration according to the invention can therefore replace the very costly selection of components, in particular microphone capsules, and thus facilitate the production process. Further, single microphone capsules for example in an array can be replaced at a later time, since the connected circuitry may automatically adapt to the new microphone capsule.

Figure 6:
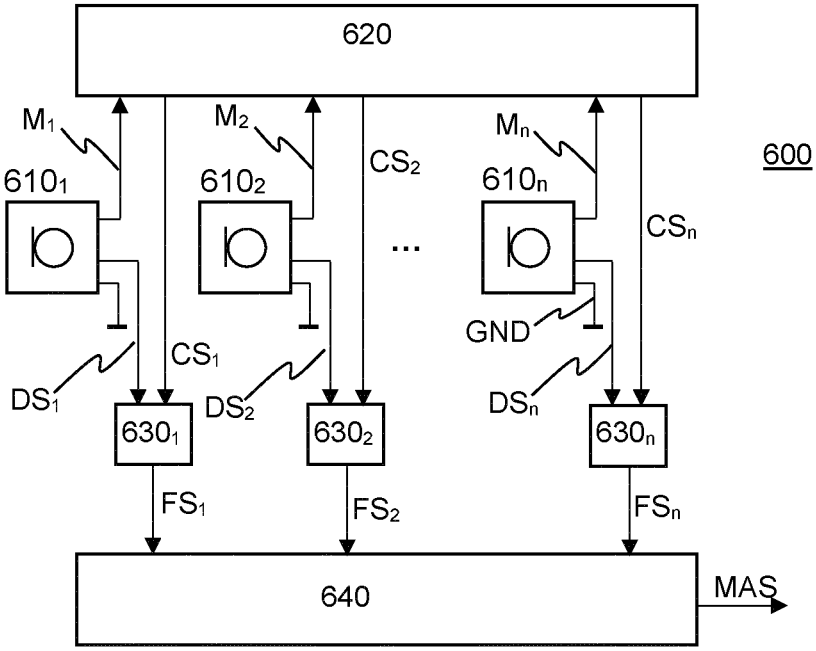
FIG. 6 shows a basic block diagram of a microphone array.

FIG. 6 shows a principle block diagram 600 of a microphone array, in one embodiment of the invention. The microphone array comprises a plurality of microphone capsules $\mathbf{610}_1, \ldots, \mathbf{610}_n$ according to the present invention, whose output signals $DS_1, \ldots, DS_n$ are combined into a common output signal MAS. For this purpose, they are processed together in a known manner in a combination block 640 by, for example, delaying and superimposing them in order to achieve a directional effect. Before that, however, the output signals $DS_1, \ldots, DS_n$ of the individual microphone capsules are individually corrected with correction filters $\mathbf{630}_1, \ldots, \mathbf{630}_n$. The correction filters are configured corresponding to their respective microphone capsules. For this purpose, a configuration unit 620 retrieves from each microphone capsule the stored values $M_1, \ldots, M_n$ and uses them to calculate configuration data $CS_1, \ldots, CS_n$, which it then uses to configure the correction filters $\mathbf{630}_1, \ldots, \mathbf{630}_n$. The output signals $FS_1, \ldots, FS_n$ of the correction filters essentially correspond to the output signals of ideal microphone capsules and can therefore be processed by the conventional combination block 640 to obtain a high quality output signal MAS. Between the microphone capsules and the correction filters, and/or between the correction filters and the combination unit, there may be further electronic components, but these are not shown here.

The configuration unit 620, the correction filters 630 and the combination unit 640 may be implemented by one or more appropriately configured processors. Normally, during manufacturing of the microphone array, two or more microphone capsules $\mathbf{610}_1, \ldots, \mathbf{610}_n$ are soldered onto a common circuit board, on which there may also be the processors and possibly further electronic components. In one embodiment, two or more of the microphone capsules $\mathbf{610}_1, \ldots, \mathbf{610}_n$ may share a common serial bus for connecting to the configuration unit in order to read out their measurement values $M_1, \ldots, M_n$ one after the other. The microphone capsules $\mathbf{610}_1, \ldots, \mathbf{610}_n$ according to the invention enable automatic manufacturing of the circuit board as well as automatic calibration of the microphone capsules, as described above.

Figure 7:
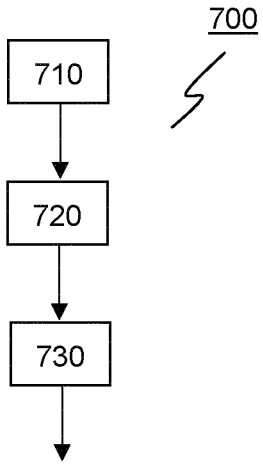
FIG. 7 shows a flow-chart of a method for calibrating a microphone array.

In one embodiment, the invention relates to a method for calibrating a microphone array that comprises a plurality of microphone capsules 200. FIG. 7 shows a flow-chart of such a method 700. In a first step 710, individual values for at least one of the microphone capsules are read out of a memory element U1 comprised in the respective microphone capsule. As described above, the values may describe an individual transfer function of the respective microphone capsule. Further, it is also possible to sequentially read out the values of a plurality of microphone capsules in this step. In subsequent steps, a compensation function per microphone capsule is calculated 720 from the read values, and at least one electronic correction circuit such as for example an electronic filter is configured 730 for the respective microphone capsule, based on the calculated compensation function. This may include, for example, setting or modifying parameters of a filter, selecting a particular filter etc. In this way, the microphone array is calibrated automatically. The method may also be used for calibrating single microphone capsules that are not mounted in an array, for example in order to perform a phase alignment for a microphone capsule that is used for noise compensation (ANC, active noise cancellation).

In one embodiment, separate electronic filters are calculated and configured for each of the at least two microphone capsules in the array. In one embodiment, an electronic filter is jointly calculated and configured for two or more of the microphone capsules.

In the microphone capsule according to the invention, the circuit board comprised therein becomes the carrier of its own calibration data. It may therefore be regarded as a 'self-calibrating' capsule. One advantage is that a meaningful correction can already be done with only few stored data (1 kbit, for example). Another advantage is that the target device (i.e. the device into which the microphone capsule is installed) can in a flexible manner control the actual frequency response and the sensitivity of the capsule based on the known target curve. In this manner, the characteristics of the target device may be automatically adjusted within a wide range.

In principle, the invention may also be used for other components or modules that offer space for an additional memory element and that due to tolerances exhibit deviations from a target characteristic that may be corrected electronically. The memory element may also be more complex than the single wire memory element described above, so that it may store more data. The memory element may also use more connections, which however may be electrically separated from the rest of the circuit, as in the examples above. The stored data are individual values of the respective component or the respective module. It may be measurement values or deviations of measurement values from target values, as described above, or values that represent a classification (for example, for deviations of 0-1%, 1-2%, 2-3% etc.); the data may facilitate selection processes during production and/or enable an automatic calibration of the finished product.

The invention claimed is:

1. A microphone capsule with a housing and, in the housing, an electrostatic sound transducer;

a first electronic circuit with an amplifier element, which receives a signal from the electrostatic sound transducer and outputs an amplified output signal, wherein the amplifier element is arranged on a circuit board; and electrical connectors at least for the amplified output signal and a reference potential;

wherein the housing of the microphone capsule comprises:

at least one further electrical connector, and a second electronic circuit with at least one electronic memory element adapted for storing data thereon that relate to the individual frequency response or phase response of the microphone capsule, wherein the memory element is arranged on said circuit board and can be read out via the at least one further electrical connector, wherein the stored data represent values of an individual transfer function of the microphone capsule at defined frequencies, wherein the stored data are deviations of the individual frequency response or phase response of the microphone capsule from defined target values.

2. The microphone capsule according to claim 1, wherein the memory element can be written to and read out via the at least one further electrical connector independently of the amplified output signal of the microphone capsule.

3. The microphone capsule according to claim 2, wherein the electrical connectors are concentric circles at the bottom side of the microphone capsule.

4. The microphone capsule according to claim 1, wherein the transfer function is a frequency response or phase response.

5. The microphone capsule according to claim 1, wherein the electrostatic sound transducer is an electret transducer manufactured in stacking technique and comprising a diaphragm assembly, the diaphragm assembly comprising a metal-coated diaphragm and a diaphragm ring.

6. The microphone capsule according to claim 1, wherein the memory element is a digital, electronically erasable single-wire memory element that is connected only to the at least one further electrical connector and to the reference potential.

7. The microphone capsule according to claim 1, wherein the first electronic circuit further comprises arranged on said circuit board one or more components for electronic adaptation, interference protection or pre-filtering.

8. A microphone arrangement comprising at least two microphone capsules according to claim 1 and a configuration unit with at least one processor, wherein the at least two microphone capsules are interconnected to form a microphone array, wherein the configuration unit is configured to read out data from the memory element of at least one of the microphone capsules, generate a configuration signal according to the read data and electronically configure at least one configuration filter for the respective microphone capsule based on the configuration signal.

9. The microphone arrangement according to claim 8, wherein each of the at least two microphone capsules is individually replaceable by a substitute microphone capsule.

10. A microphone arrangement comprising:

at least two individually replaceable microphone capsules interconnected to form a microphone array;

a configuration unit comprising at least one processor;

wherein the microphone capsules each comprise a housing and, within the housing, an electronic circuit comprising at least one electronic memory element having stored therein data relating to an individual frequency response or phase response of the respective microphone capsule, and wherein the microphone capsules each comprise a separate connector adapted for reading out the respective memory element;

wherein the configuration unit comprises for each of the at least two microphone capsules a configurable correction filter;

wherein the configuration unit is adapted for reading out the data stored in the memory element of at least one of the microphone capsules, generating a configuration signal from the read data and electronically configuring the corresponding configurable correction filter for the respective microphone capsule, thereby enabling said interconnecting the at least two microphone capsules to form the microphone array, wherein output signals of the configurable correction filters are delayed and superimposed in order to obtain a directivity of the microphone array, wherein the stored data represent values of an individual transfer function of the microphone capsule at defined frequencies, wherein the stored data are deviations of the individual frequency response or phase response of the microphone capsule from defined target values.

11. The microphone arrangement according to claim 10, wherein each of the at least two microphone capsules comprises within the respective housing a diaphragm assembly that comprises a metal-coated diaphragm and a diaphragm ring.

12. A microphone capsule with a housing and, in the housing, an electrostatic sound transducer;

a first electronic circuit with an amplifier element, which receives a signal from the electrostatic sound transducer and outputs an amplified output signal, wherein the amplifier element is arranged on a circuit board; and electrical connectors at least for the amplified output signal and a reference potential;

wherein the housing of the microphone capsule comprises:

at least one further electrical connector, and a second electronic circuit with at least one electronic memory element adapted for storing data thereon that relate to the individual frequency response or phase response of the microphone capsule, wherein the memory element is arranged on said circuit board and can be read out via the at least one further electrical connector, wherein the stored data are deviations of the individual frequency response or phase response of the microphone capsule from defined target values.

* * * * *